United States Patent [19]

Wright

[11] 4,071,222

[45] Jan. 31, 1978

[54] LIFTING PLATFORM

[76] Inventor: Howard Stanley Wright, 436 Devon St. West, New Plymouth, New Zealand

[21] Appl. No.: 734,889

[22] Filed: Oct. 22, 1976

[30] Foreign Application Priority Data

Oct. 24, 1975 New Zealand ..... 179054

[51] Int. Cl.[2] ..... B66F 7/08

[52] U.S. Cl. ..... 254/8 C; 5/62; 254/124

[58] Field of Search ..... 254/8 R, 8 B, 8 C, 4 R, 254/4 B, 4 C, 10 R, 10 B, 10 C, 122, 124; 5/62, 63, 67

[56] References Cited

U.S. PATENT DOCUMENTS

| | | | |
|---|---|---|---|
| 3,472,183 | 10/1969 | Goodman | 254/122 |
| 3,988,006 | 10/1976 | Jones | 254/124 |

*Primary Examiner*—Robert C. Watson

[57] ABSTRACT

A lifting platform which is supported from a base by a pair of X-linkages which are of the kind in which the foot of a first arm of the X is pivoted to the base, the foot of the second arm of the X slides on the base and the head of the second arm is pivoted to the platform. The invention is characterized by the head of the first arm being connected through a swinging link to the platform so the platform moves parallel to itself while being lifted.

12 Claims, 8 Drawing Figures

LIFTING PLATFORM

BACKGROUND OF THE INVENTION

This invention relates to a lifting platform.

There are many circumstances in which it is required to lift an object from a low level to a higher one in circumstances where such tools as cranes cannot be used and when the object to be lifted is too heavy, or the distance of lift is too high, for the operation to be carried out manually. One example is lifting luggage or freight to the freight door of an aircraft. Another example is supporting an object such as a petrol engine during overhaul. In both these cases it may be required that the platform carrying the object shall be tilted and it may be required that the angle of the platform in relation to the ground, whether level or tilted, remained constant during the lift. These two uses and many others might be met by the present invention, but in the description that follows reference will be made to a bed such as is now used in a hospital.

It is now usual in hospitals to try to avoid transferring patients from one piece of equipment to another. For example, if a patient is to be transferred from a medical to a surgical ward, it is desired that he shall use the same bed in both wards. It is looked on as desirable to carry the patient from one place to another in his own bed. Nevertheless the present invention is adapted to be used as the basic element of a trolley as well as of a bed. A great deal of ancillary equipment is now used in conjunction with beds in hospitals and provision must be made, if the bed is to be universally adaptable, for the incorporation of such equipment, or at least for the use of accessories in conjunction with the bed.

A hospital bed should be capable of having any height between 450 mm and 750 mm. The lifting of the patient can be accomplished by using an electrical or mechanical linear actuator, or a hydraulic ram.

The present invention has two parts. A bed using the first part would lift the patient vertically and maintain him level at all points of the lift to within the limit that can be felt by the patient or by a nurse. If however the full range of the present invention is to be used so that the patient may be tilted according to the second part with his head up or down compared with a level position, the main support for the bed must be close to a vertical line through the patient's centre of gravity and is preferably so placed that when restraint on tilting is released, the bed with a patient is heavy towards the foot by an amount that a nurse can feel but can easily handle. The range of tilting required is 25° from 10° foot down to 15° foot up, either infinitely adjustable or with step positions that will allow adjustments of approximately 2° to be made. It is desirable that the platform should maintain a level position or any preset angle within the 25° range throughout its vertical movement of 305 mm to within a tolerance of $\pm 1°$.

So that the base of x-ray equipment or of overbed tables may be accommodated, a clearance from the floor to the base (which is assumed to be carried on castors) of 127 mm is required.

Many attempts have been made to produce a design that will meet all these requirements. No practicable proposal is known which will allow the bed to be moved to the limit of tilt when it is in its lowest position and in particular that will allow the foot of the bed to be tilted down when the bed is low.

It is an object of the present invention to provide a lifting platform that will avoid the difficulties heretofore experienced or which will at least afford the public a useful choice.

SUMMARY OF THE INVENTION

Accordingly the invention may be said broadly to consist of a lifting platform supported from a base by a pair of X-linkages of the kind in which the foot of a first arm of the X is pivoted to the base, the foot of the second arm of the X slides on the base, and the head of the second arm of the X is pivoted to the platform to be lifted, wherein the head of the first arm of the X is connected through a swinging link to the platform to be lifted, whereby the platform moves parallel to itself while being lifted.

BRIEF DESCRIPTION OF THE DRAWINGS

In the following description of a preferred form of the invention reference will be made to the accompanying drawings in which.

DETAILED DESCRIPTION OF A PREFERRED FORM OF THE INVENTION

The X-linkage as described and shown here is dimensioned to suit hospital beds and trolleys but the principle used to create a low mounting point of the adjustable platform and vertical raising and lowering with the main pivot point moving at a uniform rate could, be change of scale and modifications suited to any proposed application be used for any application calling for vertical movement of a level or tilted platform.

The platform length of beds and trolleys used to support or convey adult patients seldom exceeds 2100 mm, so this may be considered a maximum length. The minimum length for a child, is taken to be about 1700 mm. The present bogey has a suitable wheel base for use under platforms of these sizes. It is considered that it would be stable under a load at the edge of the bed which very greatly exceeds the weight of a man.

Suitable platform widths range from 915 mm for a adult bed, 760 mm for a bed for a child and down to 680 mm for trolleys. The base of the bogey which is described and illustrated is 661 mm wide, i.e. about 20 mm less than the narrowest platform unit that it would have to support. The points at which the platform is attached to the bogey are within the width of the bogey base.

In the figures which show the bed from the side, the foot of the bed is to the right.

Two way tilting on hospital beds has been used for many years as have parallel motions using X-linkages. However, hospital beds that are adjustable in height are relatively new and the combination of lifting with tilting has led to a problem. It is not difficult to combine high-low with foot-up tilting but it is very difficult indeed to provide the required low position and still maintain the ability to tilt the foot end down.

Figure 1:
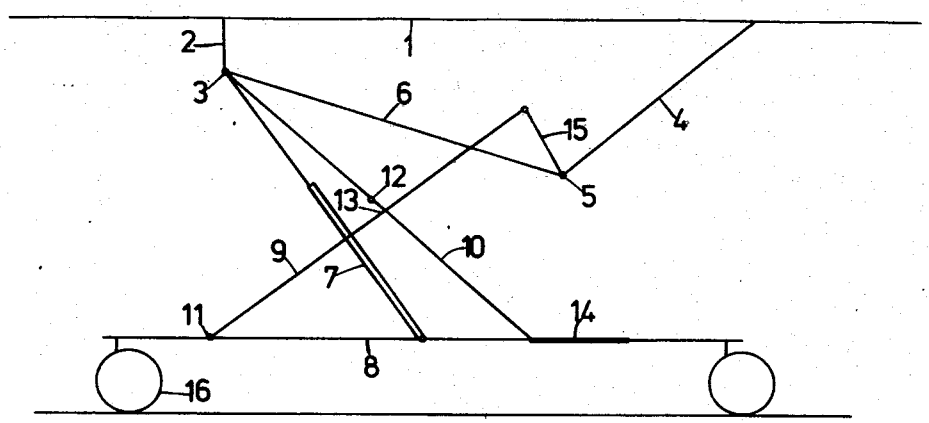
FIG. 1 is a linkage diagram related to the lifting function of a bed.

Reference will now be made to FIG. 1 which shows the linkage used in the present invention but relates only to the lifting function. The platform 1 which is to be lifted, is supported above the base 8, which in this case is supported on castors 16. So that the feet of bedside equipment may pass under base 8 it should preferably be at least 127 mm above the floor and should not be obstructed during the variations of height or tilt of the bed.

Figure 3:
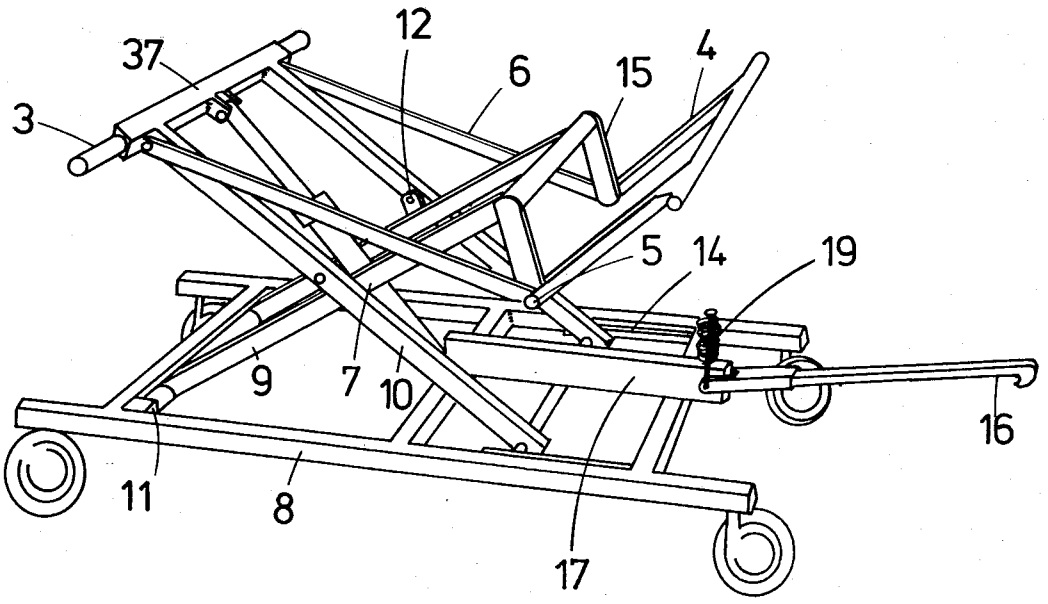
FIG. 3 shows an embodiment of the linkages of the bed at maximum height.
Figure 4:
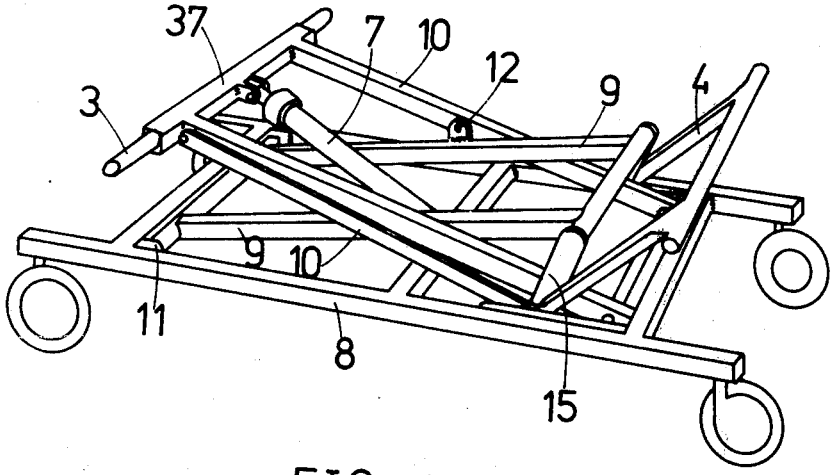
FIG. 4 shows an embodiment of linkages of the bed at the minimum height.

The height of the bed is varied by making adjustments to the pair of X-frames 9, 10, which are positioned one on each side of the bed and are joined together by cross members as shown in FIGS. 3 and 4. An X-linkage is in itself well known. In one form it consists of two members corresponding with 9 and 10 pivoted together at their middles and symmetrical about planes through the pivot in both the direction of lift and the direction perpendicular to it. One member is pivoted to the base at 11 and the other is pivoted as at 3 to the platform to be lifted. The second ends of each member move in slides, one on the base as the 14 and the other on the platform to be lifted. Because of the symmetry of the linkages, moving the foot of member 10 causes pivot 3 to move vertically towards 11 and the upper sliding point to move correspondingly to the movement at slide 14.

With this conventional form of linkage, tilting foot-down at the low point of the platform cannot be combined with bringing down the platform as low as is desired and thus it has been modified to the form shown in FIG. 1. Member 7 is not a part of the linkage and its function will be described later.

It is later disclosed that point 3 is the point about which platform 1 tilts. It is so placed along the length of platform 1 that it is a little on the head side of the centre of gravity of the patient when he or she is prone on the platform. So that platform 1 shall be able to be brought as low as possible while tilted foot down without intruding on the space below base 8, four separate variations have been made from the conventional X-linkage.

1. The part of member 10 above the pivot with member 9 is shortened so that platform pivot point 3 is lowered.

2. The upper part of member 9 is also shortened.

3. The pivot between 9 and 10 is on bracket 13 which extends upwardly from 9, so that the top of 9 is further lowered.

Figure 2:
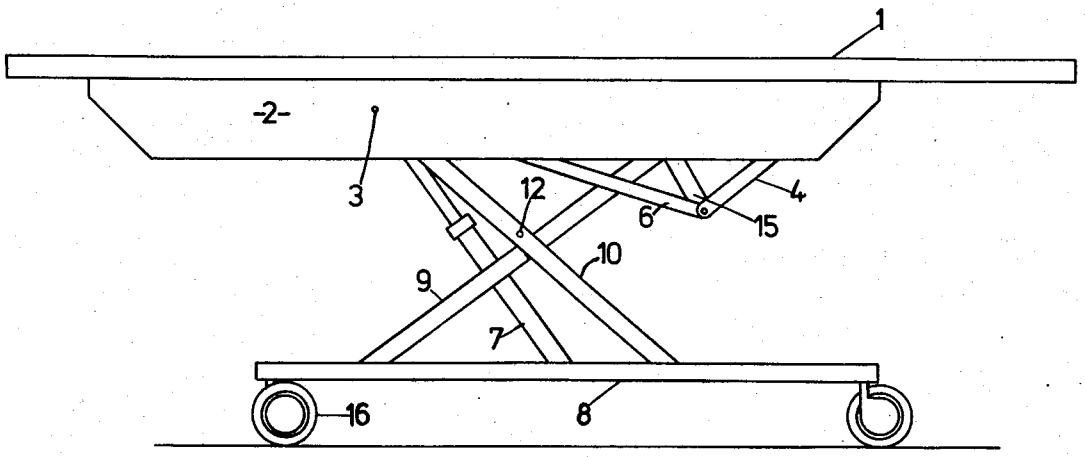
FIG. 2 is a schematic side view of a bed.

4. The slide that would normally be at the top of member 9 has been replaced by swinging link 15 pivoting at 5 to frame 2, 6, 4, which for any given tilt is fixed. The distance of point 5 from point 3 is thus fixed in all circumstances. The length of swinging link 15 is so adjusted that pivot 5 does not project below base 8 in any circumstances. It is sometimes necessary in a hospital bed to arrange that a patient's seat is lowered below the normal line of the mattress. As will be seen from FIGS. 3 and 4 there is a heavy bar across the bed connecting together the pivot points 3 of the two X-linkages. If pivot 3 were at the level of platform 1, this would interfere with the depression of the mattress so platform 1 is raised above pivot 3 by fixed bracket 2 which is shown in FIG. 2 as a skirt. Because the upper end of member 10 has been shortened, point 3 does not rise and fall in a vertical line above 11 but transverses an arc. The maximum angle from the vertical on this arc is 2.5°, a deviation that is not significant.

In FIG. 3 the bar 37 joining the pivot points 3 of the two X-linkages is seen to be of hollow square section with the rod marked at 3 passing through it. Rod 3 has different lengths for different widths of platform 1.

The dimension found convenient for using the linkage of FIG. 1 for hospital beds for an adult are:

| Part | | Millimeters |
|---|---|---|
| 1 | To right of Part 2 | 1.321 |
| 1 | To left of Part 2 | 686 |
| 2 | | 102 |
| 4 | | 450 |
| 6 | | 619 |
| 8 | From 11 to nearest point of 14 | 587 |
| 9 | From 11 to 13 | 397 |
| 9 | From 13 to 15 | 330 |
| 10 | From 14 to 12 | 397 |
| 10 | From 12 to 3 | 356 |
| 13 | | 41 |
| 14 | | 178 |
| 15 | | 143 |

Member 7 referred to above controls the height of platform 1 above base 8 and in the preferred embodiment is a hydraulic ram, integral with a reservoir 17 which includes a pump 19 operated by treadle 18. The unit consisting of ram and reservoir can very simply be removed from the bed for servicing. If it is desired to economise by using a bed with its tilting facility but without a rise and fall action, member 7 may be replaced by a fixed link. Ram 7 and reservoir 17 can simply be added afterwards if they are wanted. Alternatively the hydraulic lift can be replaced by any convenient mechanical or electrical lifting arrangement.

FIG.2 shows schematically how the linkage diagram of FIG. 1 appears in practice. The platform 1, with which is an integral skirt 2 on each side, is a normal base for a mattress as used on hospital beds and includes for instance an adjustable back rest 20 as shown on FIG. 6.

The discussion so far has assumed that platform 1 will be parallel to base 8 and will move parallel to it. The use of swinging link 15 sets a limit to the parallel movement. As the bed is lowered from the high position of FIG. 1 to the low position of FIG. 5, swinging link 15 moves through the vertical to an inclination on the other side of the vertical. It has been found that if link 15 has an inclination to the vertical of 30° at either limit of the range of vertical movement of platform 1, the variation from parallel movement of platform 1 is of the order of 1°. This is quite imperceptible to patient or nurse.

Figure 6:
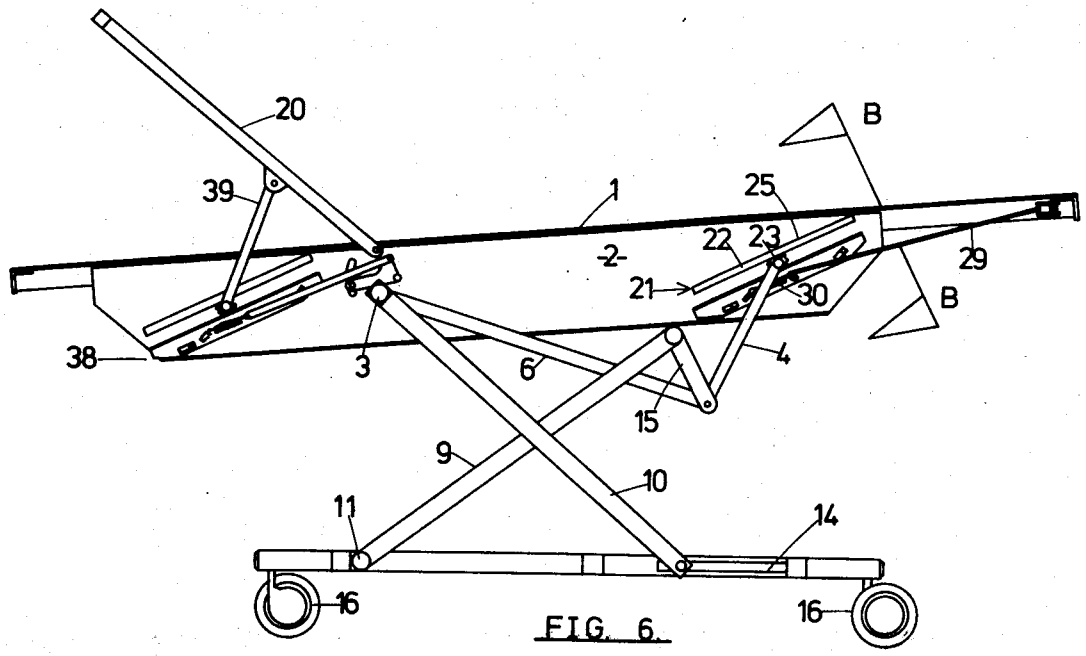
FIG. 6 is a median longitudinal cross-section of the bed.

Member 4 in FIG. 1 is used to tilt the bed. It may be used in either of two ways. In the first it is an extensible member (for example, a hydraulic jack) pivoted at both ends. Alternatively the angle of 4 in relation to platform 1 is varied and this method is adopted in the preferred form of the invention. In FIG. 6 it will be seen that member 4 is arranged to be slidable in slide 21 which is fitted on the inner surface on skirt 2.

Figure 7:
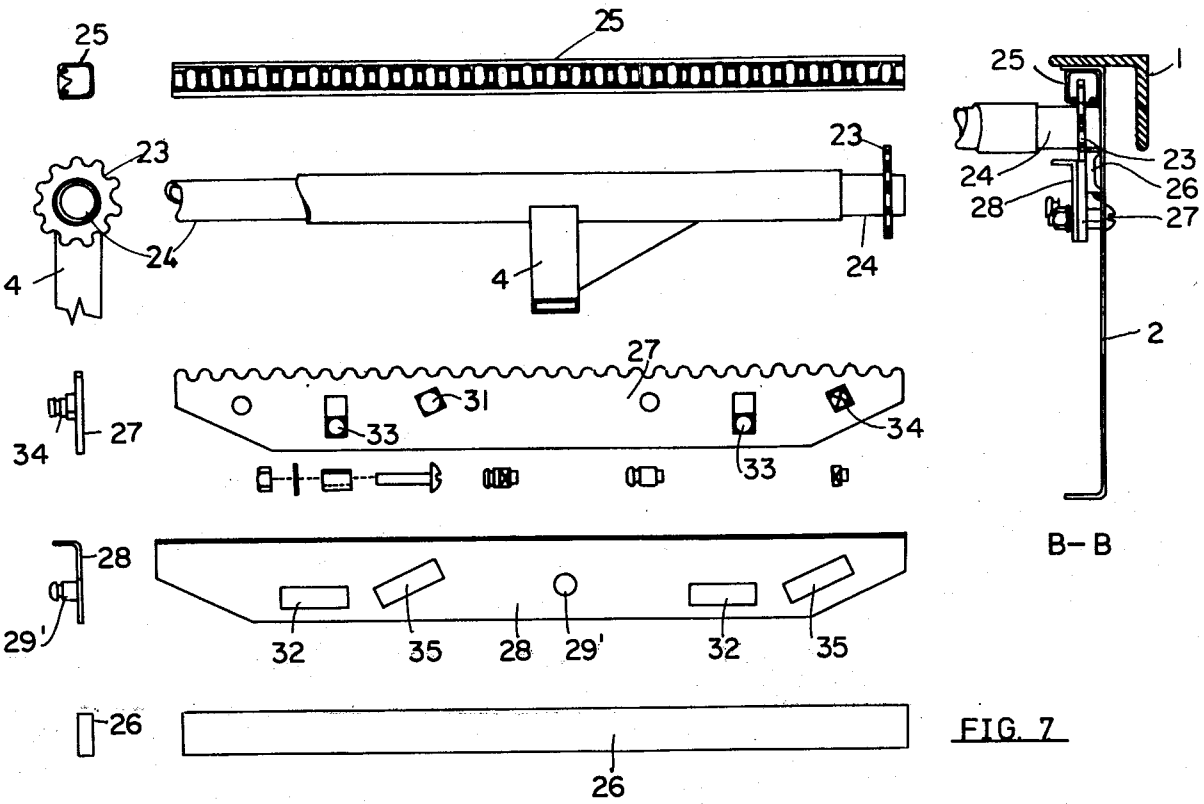
FIG. 7 shows a cross-section at BB in FIG. 6 together with component parts of the tilt control mechanism.
Figure 8:
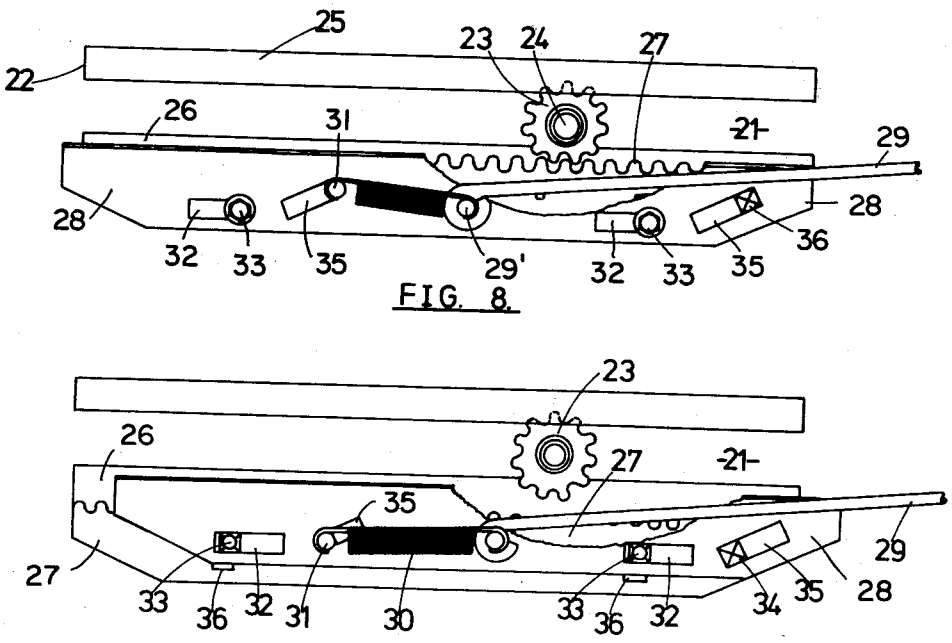
FIG. 8 shows the tilt control when adjusted to hold the angle of tilt and when adjusted to permit tilting.

Slide 21 is shown in more detail in FIGS. 7 and 8 of which FIG. 7 shows the various components in plan view and, to the left of the Figure, in end view. A section taken on line B—B of FIG. 6 is shown to the right of the Figure. FIG. 8 shows the complete slide in two different positions; the upper drawing showing the pinion 23 in a locked position, and the lower drawing showing the pinion in a free running position on rack 25.

Rack 25 is of pierced square section tube as shown in FIG. 7 and provides a line of indentations into which the teeth of pinion 23 engage. Pinion 23 is fixed on a spindle 24 which is mounted for rotation on the ends of arms 4. The pinion 23 remains in mesh with rack 25 by a guage bar 26 which is fixed to the inner surface of skirt 2 and bears against the stub end of spindle 24 (see FIG. 7).

One one side of the bed, a locking rack 27 is provided and this is located directly below pinion 23. This rack 27 is employed to lock the pinion 23 between itself and rack 25 as shown in FIG. 8. In the upper part of FIG. 8 the pinion 23 is locked between racks 25 and 27 whilst in the lower part rack 27 has been lowered to allow pinion 23 to move along rack 25.

Rack 27 does not move directly toward and away from rack 25 but rather in a direction which is angled to the line of said rack 25 and this is illustrated by the two parts of FIG. 8. This movement is achieved by cam plate 28 which is controlled by a rod 29, coupled hereto by pin 29'. A spring 30 couples rod 29 to a pin 31 protruding from rack 27 and plate 28 slides by slots 32 therein, which engage pins 33 fixed to skirt 2. Cam plate 28 also has a pair of inclined slots 35, one of which engages pin 31, and the other slot engages pin 34 of rack 27. As cam plate 28 is pulled by rod 29, rack 27 is impelled to move away from pinion 23 because of the action of pins 31 and 34 in inclined slots 35. Accordingly, rack 27 does not move laterally, due to the movement of pins 33 in slots 36.

Since the teeth of pinion 23 are somewhat flat topped as are the teeth of rack 27, the rack might not enter the pinion smoothly when it was pulled back into engagement by spring 30. To avoid this, the face of the teeth of rack 27 which in FIG. 8 are to the left are relieved at approximately 45° as can be distinguished in the upper diagram of FIG. 8.

Figure 5:
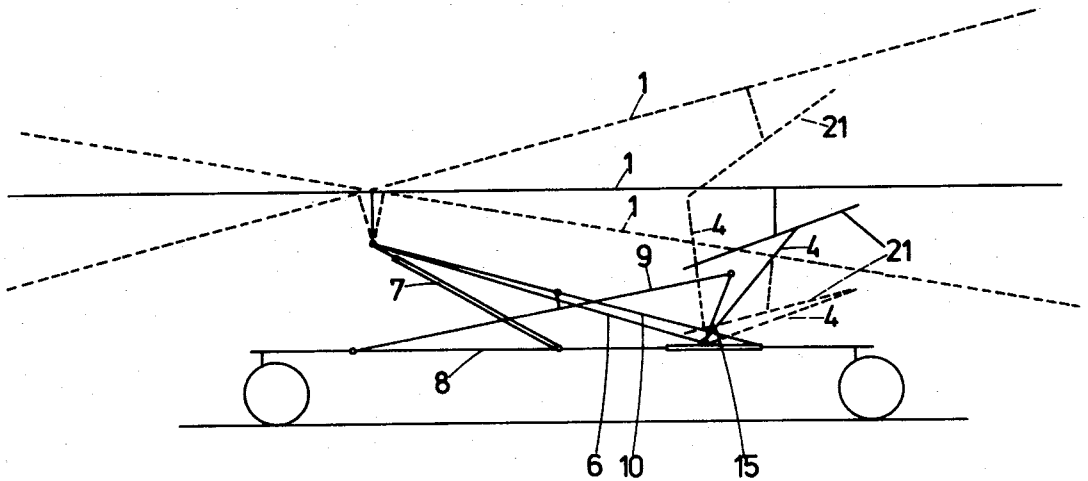
FIG. 5 is a linkage diagram related to the tilting of the bed.

With rack 27 away from pinion 32, the pinion can freely move along rack 25 and this is caused by tilting platform 1 to any desired angle, after which rack 27 is returned to the locking position by the action of spring 30. Since slide 21 is at an angle to platform 1, the length of movement that is necessary is reduced. FIG. 5, which illustrates the low position of platform 1, shows in dotted detail the variations in position of member 4 for the head down, level, and foot down tilts of platform 1. It demonstrates that in the low position with the foot down there is no obstruction to the space under base 8.

An important advantage of this mechanism is the large number of locked positions it provides. There are two locked positions for each tooth of the pinion or perforation of the top rack. Because the teeth of pinion 23 which engage with locking rack 27 are travelling twice as fast as the shaft 24, the pressure on the locking teeth, those subject to impulsive forces on the return of rack 27, are half those of the shaft. The pull needed on rod 29 is very light and can be applied in a number of ways, some operable from either side of the bed.

FIG. 6 shows that this method of controlling tilt can be applied in other circumstances, in this case, to the control of tilt of a backrest. The inclination of slide 21 in this case has an additional advantage. When backrest 20 is almost horizontal the angle between support 39 and slide 38 is not so small as to cause excessive leverage on the rack.

What is claimed is:

1. A lifting platform comprising:

a platform;

a base;

a pair of X-linkages supporting said platform above said base, a lower end of a first arm of each of said X-linkages being pivoted to said basethe lower end of the second arm of each of said X-linkages being slidably mounted to said base, the upper end of said second arm being pivoted to said platform;

a pair of swinging links, each having a first end pivotally connected to the upper end of a respective one of said first arms;

a pair of further links, each having a first end pivotally connected to the upper end of said second arm and a second end pivotally connected to a respective one of said swinging links at a point remote from said first end of said swinging link; and means linking the second ends of said swinging links to said platform, whereby said platform is movable away from said base and said platform remains parallel to a fixed plane during the movement.

2. A lifting platform as claimed in claim 1, wherein said means is a pair of secondary linkages.

3. A lifting platform as claimed in claim 2, wherein said secondary linkage and said further linkage connect to said swinging link at a common point.

4. A lifting platform as claimed in claim 2 wherein a link of the secondary linkage is adjustable in length or in the position at which it joins the platform, whereby the platform is tiltable.

5. A lifting platform as claimed in claim 3 wherein the end of the said link of the secondary linkage which joins the platform carries a pinion engaged with a first rack rigidly connected to the platform.

6. A lifting platform as claimed in claim 5 wherein the said first rack is at an acute angle to the line of lift of the platform.

7. A lifting platform as claimed in claim 5 wherein a second rack attached to the platform is adapted to slide towards and away from the first rack in a direction perpendicular to the axis of the pinion, and is removably biased by a spring into contact with the pinion.

8. A lifting platform as claimed in claim 7 wherein the teeth of the second rack are relieved to facilitate engagement with the pinion.

9. A lifting platform as claimed in claim 1 wherein the platform is a base for a bed or for a patient's trolley.

10. A lifting platform as claimed in claim 9 wherein the platform has an integral skirt on each side, an adjustable backrest on its upper surface, said first and second racks are attached to said skirt and the head of the second arm is pivotally connected to said skirt at a distance from said first and second racks.

11. A lifting platform as claimed in claim 10 further comprising:

a support arm pivotally connected to said backrest, said support arm having a pinion at its lower end;

and a set of first and second racks mounted on said skirt and engaging said pinion.

12. A lifting platform as claimed in claim 1, further comprising a linear actuator and a cross member between the heads of the two second arms, said actuator being coupled between said base and said cross member.

* * * * *